US006623599B1

(12) United States Patent
Laurila-Lumme et al.

(10) Patent No.: US 6,623,599 B1
(45) **Date of Patent: *Sep. 23, 2003**

(54) PROCESS FOR PRODUCING A PAPER WEB HAVING CALCIUM CARBONATE FILLER BY INTRODUCING CARBON DIOXIDE TO THE PULP

(75) Inventors: Auli Laurila-Lumme, Kaipola (FI); Heikki Pakarinen, Valkeakoski (FI); Hannu Juhani Leino, Espoo (FI)

(73) Assignees: AGA Aktiebolag, Lidingö (SE); UPM-Kymmene Corporation, Helsinki (FI)

( * ) Notice: Subject to any disclaimer, the term of this patent is extended or adjusted under 35 U.S.C. 154(b) by 0 days.

This patent is subject to a terminal disclaimer.

(21) Appl. No.: 09/623,380

(22) PCT Filed: Mar. 1, 1999

(86) PCT No.: PCT/FI99/00156

§ 371 (c)(1),
(2), (4) Date: Sep. 1, 2000

(87) PCT Pub. No.: WO99/45202

PCT Pub. Date: Sep. 10, 1999

(30) Foreign Application Priority Data

Mar. 3, 1998 (FI) ..... 980478

(51) Int. Cl.[7] ..... D21H 17/64; D21H 17/67; D21H 17/69; D21H 23/76

(52) U.S. Cl. ..... 162/8; 162/9; 162/83; 162/158; 162/181.2; 162/183

(58) Field of Search ..... 162/63, 9, 181.2, 162/181.4, 183, 158, 181.1, 4, 8, 90, 83

(56) References Cited

U.S. PATENT DOCUMENTS

| | | | | |
|---|---|---|---|---|
| 1,993,265 A | | 3/1935 | Dyer | |
| 2,114,809 A | | 4/1938 | Rawling | |
| 5,043,017 A | | 8/1991 | Passaretti | |
| 5,156,719 A | | 10/1992 | Passaretti | |
| 5,223,090 A | * | 6/1993 | Klungness et al. | 162/181.2 |
| 5,262,006 A | | 11/1993 | Andersson et al. | |
| 5,378,322 A | | 1/1995 | Hornsey | |
| 5,505,819 A | | 4/1996 | De Witt et al. | |
| 5,679,220 A | | 10/1997 | Matthwe et al. | |
| 6,200,416 B1 | * | 3/2001 | Brotto et al. | 162/4 |
| 6,228,161 B1 | * | 5/2001 | Drummond | 162/135 |

FOREIGN PATENT DOCUMENTS

| | | |
|---|---|---|
| EP | 0 281 273 | 9/1988 |
| EP | 0 296 198 | 12/1988 |
| EP | 0 445 952 | 9/1991 |
| EP | 0 572 304 | 12/1993 |
| EP | 0 791 685 | 8/1997 |
| GB | 2 008 562 | 6/1979 |
| WO | 88 04705 | 6/1988 |
| WO | 96 26901 | 9/1996 |
| WO | 96 28517 | 9/1996 |
| WO | 97 14651 | 4/1997 |
| WO | 98 29601 | 7/1998 |
| WO | 98 56988 | 12/1998 |

OTHER PUBLICATIONS

Eklund et al., "Paper Chemistry", *DT Paper Science Publications*, pp. 253, (1991).

Östberg Gunilla, et al, "Use of Carbon Dioxide in the Production of Sulphate Pulp", 5[th] International Conference on New Available Techniques, Stockholm, Jun. 4–7, 1996.

"Deinking pH control: putting $CO_2$ to work" Tappi Journal, Jul. 1992, pp. 247–248.

Denilson Nunes dos Santos, et al, "The Use of $CO_2$ in the Manufacture of Paper with TMP at Melhoramentos" O Papel, Apr. 1995, pp. 51–54.

Werner Stumm and James J. Morgan, "Aquatic Chemistry, Chemical Equilibria and Rates in natural Wtaers" Environment Science and Technology, John Wiley and Sons. 3[rd] Ed. 1996,ISBN 0–471–51184–6, pp. 148–190 and pp. 373–386.

* cited by examiner

*Primary Examiner*—Steve Alvo
(74) *Attorney, Agent, or Firm*—Browdy and Neimark, P.L.L.C.

(57) ABSTRACT

A papermaking process wherein calcium carbonate is included in a pulp suspension. The dissolution of the calcium carbonate in the papermaking system is substantially retarded by the introduction of carbon dioxide to said pulp suspension. The invention also provides processes for the production of paper or board in papermaking systems wherein solid calcium carbonate is present as a filler and/or pigment.

20 Claims, 3 Drawing Sheets

Figure 1:
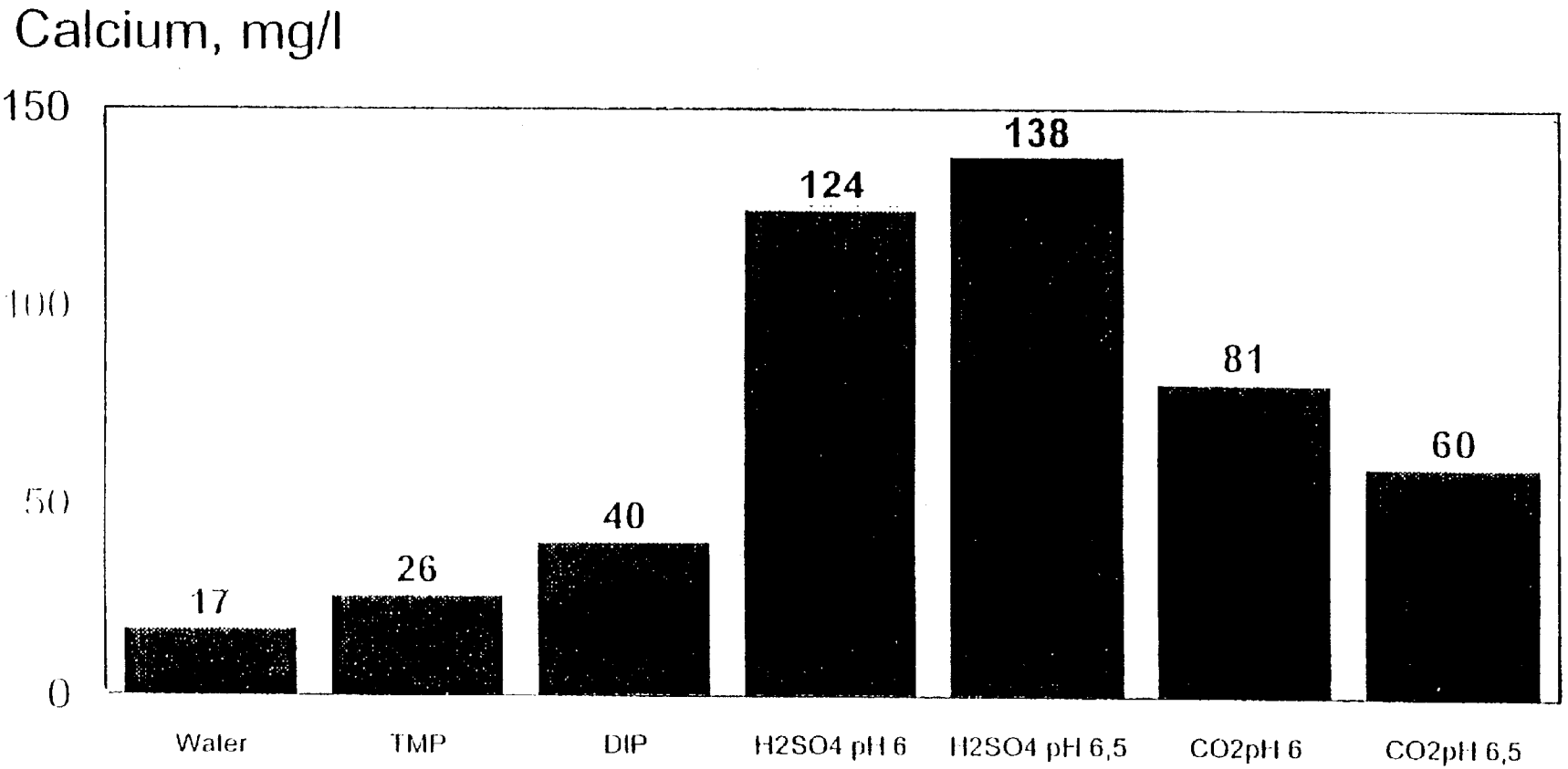

PROCESS FOR PRODUCING A PAPER WEB HAVING CALCIUM CARBONATE FILLER BY INTRODUCING CARBON DIOXIDE TO THE PULP

CROSS REFERENCE TO RELATED APPLICATION

The present application is the national stage under 35 U.S.C. 371 of PCT/FI99/00156, filed Mar. 1, 1999.

The present invention relates to the art of papermaking. In particular the invention relates to papermaking processes wherein calcium carbonate is included in a pulp suspension. Specifically, the present invention provides a process for preventing or substantially retarding the dissolution of calcium carbonate in a papermaking system containing mechanical pulp. The invention also provides processes for the production of paper or board in papermaking systems containing mechanical pulp and wherein solid calcium carbonate is present as a filler and/or pigment. Finally, the invention relates to the use of carbon dioxide for retarding the dissolution of calcium carbonate in a papermaking system.

The pulp suspension used according to the present invention comprises mechanical pulps or mixtures thereof with recycled pulps and/or chemical pulps. Special benefits of the present invention are obtained when thermomechanical pulp (TMP) is processed into paper having calcium carbonate as a filler. Such pulps and pulp combinations are currently used largely for the manufacture of supercalendered (SC) and light weight coated (LWC) papers, for newsprint and the like.

Calcium carbonate $CaCO_3$ is commonly used in papermaking as a filler or pigment because it has a high brightness and it is the whitest filler in the price range in question. The calcium carbonate may be naturally occurring chalk or calcite or it may be synthetically produced precipitated calcium carbonate (PCC). Calcium carbonate is sparingly soluble in alkaline conditions above a pH of about 8, but it is attacked by acids such as sulfuric acid and alum. as a result of which it is solubilized. Consequently, normal calcium carbonate is not a suitable filler for papermaking at an acidic pH.

In an attempt to solve the problem with solubilization of calcium carbonate at acidic pH an acid resistant precipitated calcium carbonate has been provided. However, production of this calcium carbonate is technically complicated making the use thereof expensive and even so this product is not either totally acid resistant.

Some papermakers have converted their processes from acidic to neutral pH, partly in order to be able to use calcium carbonate as a filler and/or pigment. The expression "neutral pH" corresponds in these processes to a pH in the short circulation of approximately 7–8.5, most preferably 7–8. The expression "pseudoneutral pH" refers to a pH below that at which calcium carbonate dissolves and it generally refers to a pH of 7 or lower.

Papermaking processes utilizing mechanical pulps, especially TMP, should not be run at pH levels above about 7.2, as a high pH will cause a decrease in the brightness of the paper so produced.

In papermaking processes calcium carbonate is added as a filler to the stock prior to paper formation and consequently a part of the filler particles will enter the process waters circulating in the papermaking system. When calcium carbonate is used as a pigment in coated papers, a part of the calcium carbonate will be recirculated to the process with the broke.

Recycled waste paper as well as broke (herein generally referred to as recycled fibers) may contain calcium carbonate as filler and/or pigment. The repulping of recycled fibers is generally performed at an alkaline pH wherein the calcium carbonate remains essentially in solid form. However, if the paper machine is run at an acidic, neutral or pseudoneutral pH range, the calcium carbonate deriving from the recycled fibers will start to dissolve.

Also under alkaline conditions the stock preparation and the short circulation includes addition of a number of paper chemicals and dilution waters, some of which are acidic and therefore decrease the pH of the pulp. At each acidic addition calcium carbonate may be lost and there may be foaming problems due to a decomposition of dissolved calcium carbonate.

Solubilized calcium carbonate dissociates in water according to the following equations $$CaCO_3 \leftrightarrows Ca^{2+} + CO_3^{2-}$$

$$CO_3^{2-} + H_2O \leftrightarrows HCO_3^- + OH^-$$

$$HCO_3^- + H_2O \leftrightarrows H_2CO_3 + OH^-$$

$$H_2CO_3 \leftrightarrows CO_2 + H_2O$$

At a pH below about 8 the dissolution of calcium carbonate and consequently the concentration of free calcium ions increases and foaming is observed as carbon dioxide gas is released. With use of closed circulating waters in the papermaking system, the solubilization of calcium carbonate accumulates high concentrations of calcium ions which cause complex problems in the papermaking. Among these problems there may be mentioned coagulation of sticky particles, soap and ink particles; precipitation of inorganic calcium salts as a scaling; precipitation of calcium oxalate and reprecipitation of calcium carbonate: a decrease in the swelling ability of the fibers; interference with retention aids, dispersants and other charged paper additives; etc.

Consequently, there exists a need to improve the use of calcium carbonate in paper making processes, especially processes wherein mechanical pulps such as TMP are included.

Carbon dioxide is a gas, which dissolves in water or a pulp suspension forming carbonic acid and/or bicarbonate ions according to the reaction:

$$CO_2 + H_2O \leftrightarrows H_2CO_3 \leftrightarrows H^+ + HCO_3^-$$

Use of carbon dioxide in paper making has been suggested in the prior art for various reasons. According to U.S. Pat. No. 1,993,265 carbon dioxide is used for inhibiting the destructive action of calcium carbonate on a rosin size precipitated with alum.

According to U.S. Pat. No. 2,114,809 a calcium carbonate containing stock is sized using alum, whereby carbon dioxide is created in the reaction between alum and carbonate filler.

According to U.S. Pat. No. 5,378,322 bicarbonate ions required for catalyzing non-acidic sizing with alkylketene dimers may be generated by dissociation of carbon dioxide in the aqueous pulp. If calcium carbonate is added as a filler, the catalytic bicarbonate ions may be produced by a reaction between dissolved carbon dioxide and calcium carbonate. However, this combination of carbon dioxide and calcium carbonate is proposed only for a pH down to 8.6.

According to U.S. Pat. No. 5,262,006 precipitation of gypsum in an alkaline recycle or broke derived pulp may be prevented by adding carbon dioxide to form bicarbonate ions in the alkaline pulp and to precipitate the calcium as calcium carbonate providing PCC in the processing system.

According to EP Patent 0 296 198 the washing of alkaline pulps may be improved by adding carbon dioxide to the washing water.

According to EP Patent 0 281 273 carbon dioxide may be used for adjusting the pH of alkaline pulps upstream of the fibrillation step.

According to GB Patent Application 2 008 562 carbon dioxide may be used for increasing the solubility of calcium carbonate and for the hardening of recycled waters used in the treatment of pulp from waste paper.

It is well known in the art that the solubility of calcium carbonate increases with decreasing pH. According to literature (D. Ekiund, T. Lindstrom, Paper Chemistryo—an introduction, DT Paper Science Publications, Grankulla, Finland 1991, p. 253) an increase in the carbon dioxide partial pressure increases the solubility of calcium carbonate. Consequently, the prior art papermaking processes have recommended the use of calcium carbonate as a filler for alkaline but not for the acidic or neutral papermaking which is typical when TMP is used in the process.

It has now surprisingly been found that carbon dioxide may be used to improve the function of calcium carbonate in paper making processes operating at pH levels below those at which calcium carbonate traditionally has been used.

The invention according to the present application is defined in the appended claims, the contents of which are included herein by reference.

Consequently, the present invention relates to a process for preventing or substantially retarding the dissolution of calcium carbonate in a papermaking system comprising providing in said papermaking system an aqueous pulp suspension containing mechanical pulp, introducing carbon dioxide to said pulp suspension, causing solid calcium carbonate to be present in said pulp suspension at pH conditions below 8, said carbon dioxide being introduced in an amount sufficient to significantly retard dissolution of said calcium carbonate in said pulp suspension at said pH conditions.

The carbon dioxide is introduced in an amount sufficient to significantly retard dissolution of said calcium carbonate in a TMP containing suspension and reduce the amount of free calcium ions in said papermaking system compared to a similar papermaking system operating without carbon dioxide.

The fact chat carbon dioxide does retard the dissolution of calcium carbonate is in itself surprising and contrary to the beliefs of the prior art. Without wishing to be bound by any theory, the inventors believe that the effect of the carbon dioxide is due to the increased amount of carbonate ions which result from the dissolution of carbon dioxide in the aqueous medium. These carbonate ions affect the balance of the dissociation equation of calcium carbonate in such a way that calcium carbonate has a lower tendency for dissolving and dissociating. Thus, a large part of the calcium carbonate is maintained in solid form and is removed with the paper web. The amount of free calcium ions in the pulp suspension and in the circulating process waters is significantly reduced and there is no accumulation of calcium ions.

The required amount of added carbon dioxide depends on the pH, on the other process conditions as well as on the amount of calcium carbonate present in the pulp suspension. The amount of carbon dioxide, added to the pulp suspension may be significant, up to about 5 to 7 kg/ton or even more. Trials have been made with values between 2 and 15 kg/ton with good results. A high amount of carbon dioxide has a clear pH lowering effect on the pulp suspension and a lower pH is known to increase the solubilization of calcium carbonate. However, in the working of the present invention it was surprisingly found that the carbon dioxide retarded the dissolution of calcium carbonate even though the pH was decreased. Thus, decreasing the pH with carbon dioxide does not have the same negative effects on calcium carbonate as decreasing the pH with other acids.

The calcium carbonate in the pulp suspension may derive from calcium carbonate added to the pulp suspension as a filler or it may be provided by calcium carbonate included as a coating pigment in recirculated broke. Alternatively, at least part of the calcium carbonate in the pulp suspension may derive from recycled fibers containing significant amounts of calcium carbonate as filler and/or pigment.

The present invention also provides a process for producing paper or board in a papermaking system wherein solid calcium carbonate is present. The process comprises the steps of providing in said papermaking system an aqueous pulp suspension containing mechanical pulp, introducing carbon dioxide to said pulp suspension, causing solid calcium carbonate to be present in said pulp suspension at pH conditions below 8, said carbon dioxide being introduced into said pulp suspension in an amount sufficient to significantly retard the dissolution of said calcium carbonate in said pulp suspension at said pH conditions, feeding said calcium carbonate containing pulp suspension via stock preparation steps to a web forming device, and processing said web into paper having calcium carbonate filler.

If the pH in a calcium carbonate containing suspension has been adjusted with a strong acid such as sulfuric acid below the critical level of pH about 8, the calcium carbonate will start to dissolve. The dissolving is generally the quicker the lower the pH is. In some cases is may be acceptable to lower the pH of the pulp suspension to as low as 7.5 or even 7 with other acids, provided that carbon dioxide is introduced into the suspension fairly quickly after the pH decrease below about 8. It is preferable, however, to provide any pH decrease below about pH 8 with the carbon dioxide itself, in which case the solubilization of calcium carbonate will be retarded according to the invention.

The present invention also relates to the use of carbon dioxide for preventing or substantially retarding the dissolution of calcium carbonate in a papermaking system comprising introducing carbon dioxide into an aqueous suspension containing mechanical pulp, causing solid calcium carbonate to be present in said pulp suspension at pH conditions below 8, said carbon dioxide being introduced in an amount sufficient to significantly retard dissolution of said calcium carbonate in said pulp suspension at said pH conditions.

Figure 2:
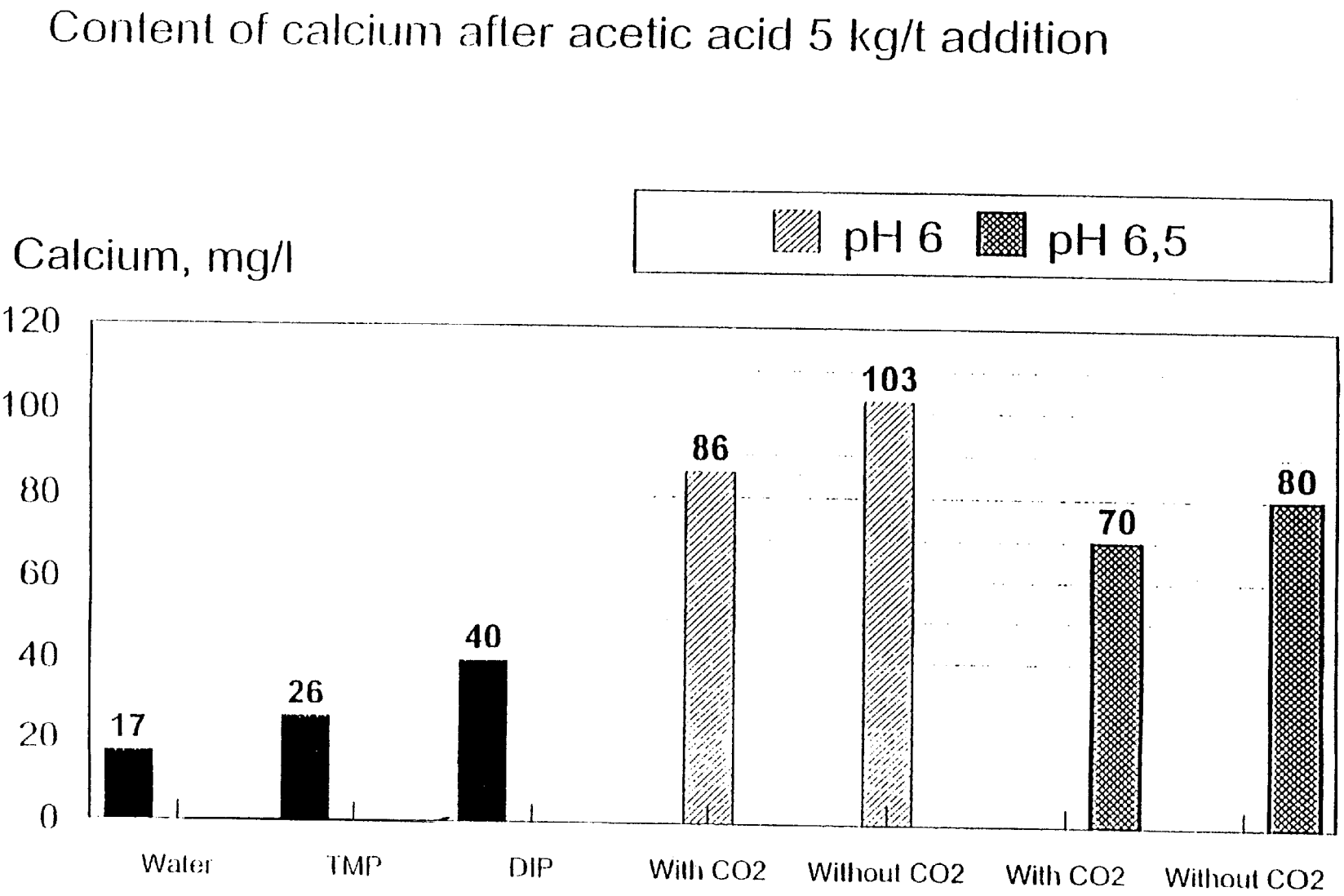
Figure 3:
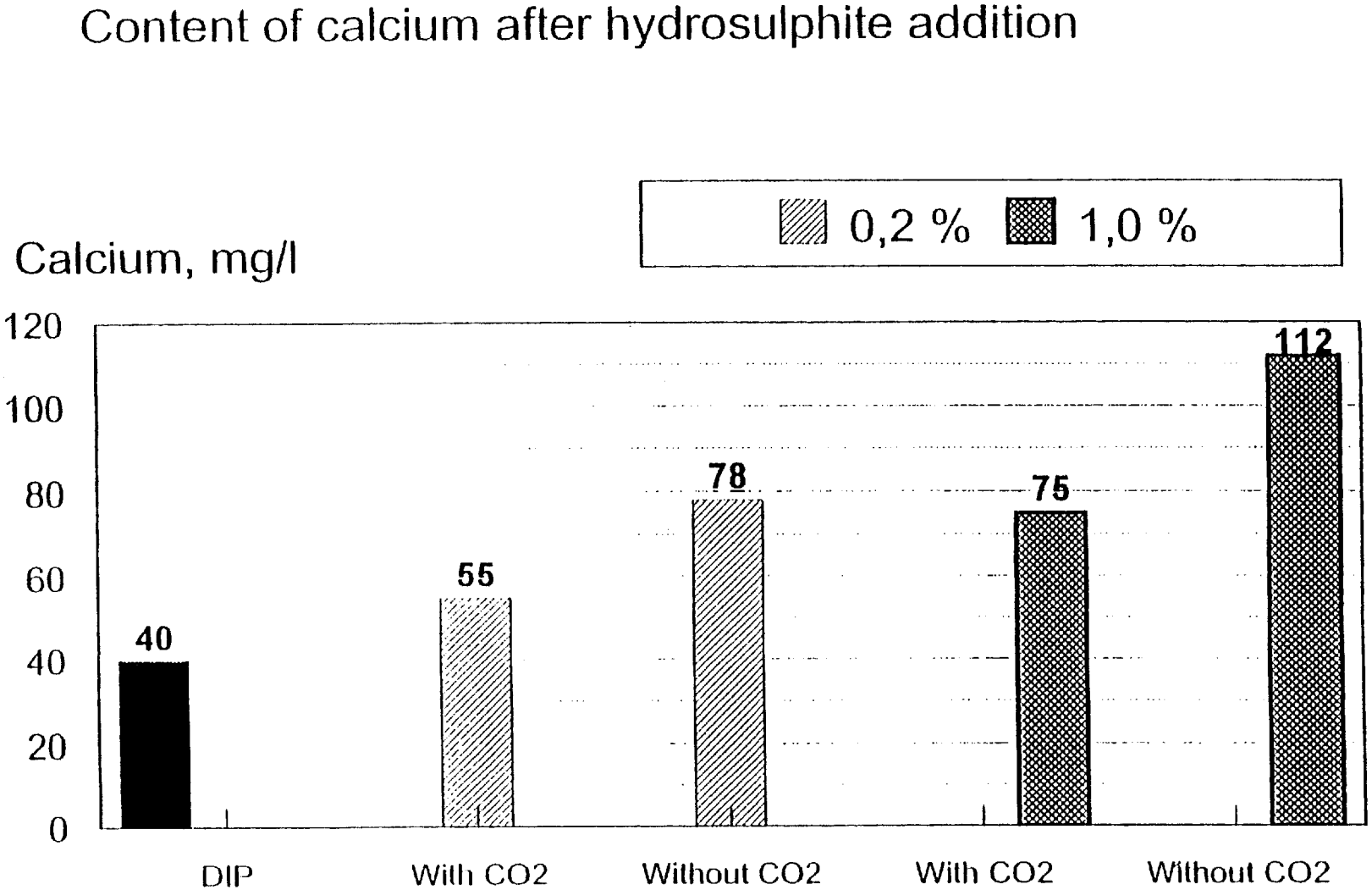

FIGS. 1–3 show the results of Example 1, Test Runs 1 to 3 respectively.

In the operation of the present invention the carbon dioxide should be introduced into a TMP containing pulp suspension prior to subjecting the calcium carbonate to pH conditions below the critical level where it would otherwise dissolve. The carbon dioxide should be introduced in a manner whereby the effect of the carbon dioxide is actively present to counter the solubilization of the calcium carbonate.

The carbon dioxide may be introduced into a stream of pulp suspension or it may be introduced into a stream of water, such as into a recirculating process water, which is then added to said pulp suspension.

Additional carbon dioxide may preferably be introduced into said calcium carbonate containing pulp suspension in connection with additions of acidic process chemicals to said pulp suspension.

As mentioned above, carbon dioxide has an inherent capacity of decreasing the pH and this capacity may be utilized in the present invention in order to provide a desired decrease in the pH of a pulp suspension. Thus, carbon dioxide may be introduced in an amount sufficient for lowering the pH of said pulp suspension below the critical level of pH 8, or, when another acid has been used for decreasing the pH, carbon dioxide may preferably be used to decrease the pH further. The pH of the pulp suspension may, for instance, be adjusted with carbon dioxide to a pH of 5.5 to 7.6, preferably 6.5 to 7.5.

The carbon dioxide should preferably be introduced prior to and/or in connection with any step in which the calcium carbonate containing pulp suspension is diluted with water having a pH of 8 or lower.

Mechanical fibers and recycled fibers are often bleached with bleaching agents such as dithionite which cause a reduction in the pH due to side reactions in the bleaching or by-products of the bleaching agent. The properties of the stock itself also affects the amount of pH reduction which may occur. To counter the pH reducing effect, carbon dioxide should preferably be introduced prior to the dithionite bleaching of the pulp suspension.

When a calcium carbonate containing recycled pulp enters a paper making process operating at a neutral or acidic pH, carbon dioxide is preferably introduced into the pulp before the contact between liquids at different pH levels takes place.

Aqueous pulp suspensions deriving from chemical or mechanical pulps are basically devoid of calcium carbonate. In such cases calcium carbonate generally comprises a solid filler which is added into said pulp suspension in a papermaking process. The calcium carbonate is preferably added in a stock preparation step, such as prior to and/or in a stock preparation tank.

The calcium carbonate which first enters the pulp suspension may also comprise calcium carbonate contained in process waters recirculated from said papermaking process. In such a case it may be preferable to introduce carbon dioxide into the process water before it enters the pulp suspension. Additional carbon dioxide may be introduced into the stock at a subsequent process step prior to web forming.

In the operation of the process according to the present invention carbon dioxide should be introduced into the pulp suspension in an amount sufficient to significantly increase the amount of undissolved calcium carbonate in the stock entering the web forming device of the papermaking machine compared to a corresponding stock which has not been treated with carbon dioxide.

The present invention improves the use of calcium carbonate in TMP containing pulps in paper production at a substantially neutral or even acidic pH.

Various situations wherein the problems of solubilization and dissociation of calcium carbonate are encountered in papermaking are described below with the aid of some examples. Said examples are only illustrative of the invention and should in no case be taken as limiting the scope of the invention.

EXAMPLE 1

Laboratory Tests Showing the Effect of Carbon Dioxide on the Dissolution of Calcium Carbonate A pulp comprising de-inked pulp (DIP) and/or thermomechanical pulp (TMP) at a consistency of 3 to 4% and at a temperature of 50° C. were mixed with carbon dioxide in a covered laboratory mixer. A calcium carbonate slurry was added to the pulp after the addition of carbon dioxide. The mixing time was 2 hours. Thereafter the pulp was filtered using a Blue band filter pad (Slicer & Scholl 589/3) and the amount of calcium present in the filtrate was measured using an Atom Absorption Spectrometer (AAS).

In test No. 1, the pH of a pulp blend of DIP and TMP was lowered to 6.5 and 6.0, respectively, using a) $H_2SO_4$ and b) $CO_2$. The results are indicated in FIG. 1 (Content of dissolved calcium in TMP—DIP blends).

In test No. 2, the pH of a pulp blend of DIP and TMP was adjusted to 6.5 and 6.0, respectively, as in the first test. An addition of acetic acid corresponding to an addition of 5 k acetic acid per ton was made to the respective pulp suspensions. The results are indicated in FIG. 2 (Content of calcium after acetic acid 5 kg/t addition).

In test No. 3, the pH of a DIP suspension was adjusted a) without CO2 (with $H_2SO_4$) and b) with $CO_2$, and the effect of a hydrosulphite addition of 0.2% and 1.0%, respectively, on the dissolution of calcium carbonate was analyzed. The results are indicated in FIG. 3 (Content of calcium after hydrosulphice addition).

The results of tests No. 1 to 3 clearly show that the dissolution of calcium carbonate is significantly lower when carbon dioxide has been introduced into the pulp.

In test No. 4 the pH of a TMP suspension was adjusted with a) $H_2SO_4$ and b) $CO_2$. The effect of calcium carbonate and carbon dioxide on colloidal size extractives was measured. It was found that the original $H_2SO_4$ adjusted TMP had 27 ma/l colloidal size extractives in the filtrate: the same TMP to which $CaCO_3$ had been added, had 21 ma/l colloidal size extractives; while the $CO_2$ treated $CaCO_3$ containing TMP had as much as 35 ma/l colloidal size extractives in the filtrate. This indicates that the extractives are more agglomerated with calcium in case the pH adjustment is made with $H_2SO_4$ than with $CO_2$.

EXAMPLE 2

Dosing of Acidic Process Chemicals Into $CaCO_3$ Containing Stock

A pulp suspension consisting of a blend of de-inked pulp (DIP) and thermomechanical pulp (TMP) and including a significant amount of calcium carbonate deriving from recycled fibers is used for the production of fully dyed paper. The pH of the stock is adjusted to pH 6, A) according to the prior art with sulfuric acid, and B) according to the present invention with carbon dioxide. In the stock preparation an addition of about 5 kg/ton of an acidic process chemical is made to the stock.

The acid addition causes a sudden local reduction of the pH of the stock which accelerates the dissolution of calcium carbonate. The amount of dissolved calcium is measured in the laboratory and is found to be in case A) above 100 mg/l, and in case B) below 90 mg/l.

This indicates that by adding carbon dioxide into the stock, the effect of sudden pH reduction on the dissolution of calcium carbonate can be alleviated.

EXAMPLE 3

Dosing of Bleaching Agents Into $CaCO_3$ Containing Stock

A pulp suspension consisting of a blend of de-inked pulp (DIP) and thermomechanical pulp (TMP) and including a significant amount of calcium carbonate deriving from recycled fibers is bleached using dithionite (hydrosulphite) as bleaching agent. The pH is adjusted to about 6 before the bleaching A) with sulfuric acid and B) with carbon dioxide.

The bleaching typically causes a reduction of pH which accelerates the dissolution of calcium carbonate which is present in solid form in the process. The introduction of carbon dioxide into the pulp significantly reduces the effect of the bleaching agent. With an addition of about 2 kg/ton of hydrosulphite the content of dissolved calcium in the pulp is found to be about 80 mg/l in case A) and about 55 mg/l in case B).

This indicates that the use of carbon dioxide can alleviate the problem of calcium carbonate dissolution in a pulp suspension.

EXAMPLE 4

$CaCO_3$ as a Filler or Coating Pigment in Paper Making at a Pseudoneutral pH Calcium carbonate is a used as a filler or coating pigment in the production of paper from a pulp containing a significant amount of mechanical pulp. Because of the mechanical pulp the paper making process is run in the acidic or pseudoneutral area (a pH at which calcium carbonate is normally solubilized).

Carbon dioxide is introduced into the papermaking process to provide a final pH of 6.5 in the stock preparation. Because of the carbon dioxide addition the dissolution of the calcium carbonate is retarded. A substantial amount of the calcium carbonate in the stock is retained in solid form and is removed with the paper web, The amount of free calcium ions found in the recirculating process waters remains at an acceptable level causing no significant problems.

EXAMPLE 5

CaCO as Filler in Paper Making With TMP

Reference Example a): Use of Sulfuric Acid

A paper mill has one paper machine producing supercalendered (SC) paper. The raw material is made up of 70% TMP (thermo mechanical pulp) and 30% bleached kraft pulp. The pH of the stock entering the short circulation is 5.8–6.3. The machine is run with a pH in the head box of 6.0–6.5. The pH in the short circulation is controlled with an addition of $H_2SO_4$ in the wire pit. Because of the acidic conditions, the mill uses kaolin clay as a filler and the process runs smoothly.

Reference Example b): Use of Calcium Carbonate

The process of Reference Example a) is repeated using $CaCO_3$ instead of kaolin as a filler.

In order not to dissolve the filler, the pH of the stock entering the short circulation is adjusted to pH 7.8.

The produced paper is yellowish and lacks brightness due to the effect of the high pH on the mechanical pulp. The calcium ion concentration gradually increases due to dissolution of calcium carbonate. Precipitations of calcium salts occur in the process.

Working Example: Use of Carbon Dioxide

The process of Reference Example b) is changed in order to improve the situation.

The acidifications in the process are performed by the use of carbon dioxide and the dilution water contains no sulfuric acid. The pH of the pulp suspension is adjusted to a pH of 7 to 7.2 just prior to the stock preparation tank.

Due to the use of carbon dioxde, the white water contains significantly less dissolved calcium carbonate. A larger proportion of the added calcium carbonate is retained in solid form and is removed as filler in the web formed in the paper making process.

The examples show that the use of carbon dioxide provides a significant improvement in the calcium carbonate balance of a paper making system.

It is evident to those skilled in the art that the invention may be varied in a great number of ways which are obvious to those skilled in the art without deviating from the scope of the claims.

What is claimed is:

1. A process for preventing or substantially retarding the dissolution of calcium carbonate in a papermaking system comprising providing in said papermaking system an aqueous pulp suspension containing mechanical pulp, introducing carbon dioxide to said pulp suspension containing mechanical pulp, causing solid calcium carbonate to be present in said pulp suspension at pH conditions below 8, wherein said calcium carbonate is added to said pulp suspension as solid calcium carbonate filler, said carbon dioxide being introduced in an amount sufficient to significantly retard dissolution of said calcium carbonate, reduce the amount of free calcium ions and reduce the precipitation of calcium salts in said pulp suspension at said pH conditions.

2. The process according to claim 1, wherein said pulp is a thermomechanical pulp (TMP) having a pH below 7.5.

3. The process according to claim 1, wherein at least part of said calcium carbonate in said pulp suspension derives from recycled fibers or broke containing calcium carbonate as filler or pigment.

4. The process according to claim 1, wherein said carbon dioxide is introduced into a stream of pulp suspension or into a stream of water which is then added to said pulp suspension.

5. The process according to claim 1, wherein said pH conditions comprise a pH of 5.5 to 7.6.

6. The process according to claim 1, wherein the pH of said pulp suspension is adjusted with carbon dioxide to a pH of 7 to 7.2.

7. The process according to claim 1, wherein said carbon dioxide is introduced prior to a dithionite bleaching of said pulp suspension.

8. The process according to claim 1, wherein calcium carbonate is added to said pulp suspension with process water recirculated from a papermaking process.

9. The process of claim 1 wherein said pH is 6.5–7.5.

10. The process of claim 1 wherein said pH is 7–7.2.

11. The process of claim 1 wherein the sequence of operation comprises introducing said carbon dioxide to said pulp suspension prior to addition of said solid calcium carbonate.

12. A process for producing paper or board in a papermaking system wherein sold calcium carbonate is present, characterized in providing in said papermaking system an aqueous pulp suspension containing mechanical pulp, introducing carbon dioxide to said pulp suspension, causing solid calcium carbonate to be present in said pulp suspension at pH conditions below 8, said carbon dioxide being introduced into said pulp suspension in an amount sufficient to significantly retard the dissolution of said calcium carbonate, reduce the amount of free calcium ions and reduce the precipitation of calcium salts in said pulp suspension at said pH conditions, feeding said calcium carbonate containing pulp suspension via stock preparation steps to a web forming device, and processing said web into paper having calcium carbonate filler.

13. The process according to claim 12, wherein carbon dioxide is introduced into said pulp suspension in an amount sufficient to retain said solid calcium carbonate in an undissolved state for a time sufficient for said pulp suspension to be processed into a web at a pH below 7.5.

14. The process according to claim 13, wherein carbon dioxide is introduced into said suspension in an amount sufficient to significantly increase the amount of undissolved calcium carbonate in the stock entering said web forming device compared to a corresponding stock which has not been treated with carbon dioxide.

15. The process according to claim 12, wherein said pulp comprises thermomechanical pulp.

16. The process according to claim 12, wherein carbon dioxide is first introduced into said pulp suspension at a position upstream of a bleaching step and additional carbon dioxide is introduced to said pulp suspension at a subsequent process step prior to web forming.

17. The process according to claim 12, wherein said paper is produced at a pH of 6.5 to 7.5.

18. The process of claim 12, wherein said pH is 7–7.2.

19. In a method of making paper from a pulp suspension having a pH no greater than about 7.2, said pulp suspension comprising a mechanical pulp or a mixture thereof with at least one of a recycled pulp and a chemical pulp, the method comprising increasing the whiteness of the resultant paper by incorporating a pigment into said pulp suspension, the improvement wherein staid pigment comprises solid calcium carbonate, and retarding solubilization of said solid calcium carbonate by introducing carbon dioxide into said pulp suspension in an amount sufficient to significantly retard dissolution of calcium carbonate reduce the amount of free calcium ions and reduce the precipitation of calcium salts.

20. The method of claim 19 wherein said pulp suspension comprises a thermo-mechanical pulp, and said pulp suspension contains at least one of sulphuric acid and alum, and said carbon dioxide is introduced into said pulp suspension prior to and/or in connection with mixing said solid calcium carbonate with said pulp slurry at a pH no greater than 7.2.

* * * * *